United States Patent [19]

Heberle et al.

[11] 4,206,607

[45] Jun. 10, 1980

[54] GAS DYNAMIC WAVE MACHINE

[75] Inventors: Hansjörg Heberle, Bodman-Ludwigshafen; Wolfgang Rudert, Langenargen, both of Fed. Rep. of Germany

[73] Assignee: BBC Aktiengesellschaft, Baden, Switzerland

[21] Appl. No.: 850,394

[22] Filed: Nov. 10, 1977

[30] Foreign Application Priority Data

Nov. 11, 1976 [DE] Fed. Rep. of Germany ..... 2651473

[51] Int. Cl.[2] ..... F02B 37/00

[52] U.S. Cl. ..... 60/611; 60/608

[58] Field of Search ..... 60/39.45, 445, 487, 60/597, 598, 605, 607, 608, 611

[56] References Cited

U.S. PATENT DOCUMENTS

| | | | |
|---|---|---|---|
| 2,307,851 | 1/1943 | Musick et al. | 60/487 X |
| 2,490,115 | 12/1949 | Clarke | 418/19 X |
| 2,968,914 | 1/1961 | Birmann | 60/608 |
| 3,039,267 | 6/1962 | Voreaux et al. | 60/445 |
| 3,180,330 | 4/1965 | Barnes | 60/39.45 X |
| 3,473,322 | 10/1969 | Wolf | 60/607 |
| 3,869,866 | 3/1975 | Timoney | 60/607 |
| 3,927,530 | 12/1975 | Braun | 60/607 |

*Primary Examiner*—Michael Koczo

*Attorney, Agent, or Firm*—Craig & Antonelli

[57] ABSTRACT

A gas dynamic wave machine or gas dynamic pressure exchanger for a supercharged internal combustion engine with the wave machine including a rotor or cell wheel driven by an independent drive arrangement. A charging air line is interposed between the gas dynamic wave machine and the respective cylinders of the internal combustion engine with the charging air line being selectively opened and closed in dependence upon an operative state of the internal combustion engine. A device is provided for delaying an opening of the charging air line for a predetermined time interval following a starting operation of the internal combustion engine. The independent drive arrangement for the wave machine is constructed as a hydrostatic drive device.

4 Claims, 3 Drawing Figures

GAS DYNAMIC WAVE MACHINE

The present invention relates to a compressor arrangement and, more particularly, to a gas dynamic wave machine or pressure exchanger arrangement for a supercharged internal combustion engine with the gas dynamic wave machine including a rotor or cell wheel having an independent and separate drive and with a charging air line from the charging wave machine to the internal combustion engine being closed or sealed by a valve means during a non-operating condition of the internal combustion engine.

By virtue of the use of a gas dynamic wave machine or pressure exchanger, the energy of the exhaust gas from the internal combustion engine is employed for a precompression of the charging air for the internal combustion engine whereby the two flow media, i.e., the exhaust gas and charging air, come into direct contact with one another within the rotating rotor or cell wheel. Generally, the rotor or cell wheel requires a drive having a power consumption of approximately 1-2% of the power of the associated internal combustion engine. The lower power requirement is possible by virtue of the fact that the exhaust gas from the internal combustion engine supplies the necessary compression energy so that the rotor or cell wheel drive need only overcome windage and friction losses in the bearings.

It has been proposed to provide V-shaped drive belts and pulleys or gears to drive the rotor or cell wheels of gas dynamic wave machines with a hydrodynamic clutch possibly being incorporated into the drive system.

The afore-mentioned proposed drive systems have a significant disadvantage in that the location of the gas dynamic wave machine or pressure exchanger on the internal combustion engine cannot be freely selected due to the limited areas in which a proper drive connection can be accomplished. Moreover, the use of a belt and pulley system is disadvantageous from the point of view of frequent inspection and/or maintenance of the belts.

It has also been proposed to separately drive the rotor or cell wheel by an electric motor. However, especially in the case of an internal combustion engine utilized to drive a vehicle, the electric motor drive imposes an intolerable load on the electrical system of the vehicle. Moreover, the size of the electric motor required to drive the rotor or cell wheel, even with a comparatively small amount of power required for driving purposes, is so large that considerable problems arise in installing the electric motor in conjunction with internal combustion engines of a compact design.

The aim underlying the present invention essentially resides in providing a gas dynamic wave machine or pressure exchanger for a supercharged internal combustion engine in which an improved independent and separate drive system is provided for the rotor or cell wheel.

According to one advantageous feature of the present invention, the rotor or cell wheel is driven by an independent hydrostatic drive system. By virtue of the provision of such a drive system, it is possible to locate the gas dynamic wave machine or pressure exchanger at more convenient locations with respect to the internal combustion engine since the pressure medium which serves to drive is conducted by pressure medium lines which can be freely located.

According to another advantageous feature of the present invention, a sealing valve means is arranged in the charging air line which is adapted to close or seal such line when the internal combustion engine is not operating with the sealing valve means opening at a predetermined time interval after the internal combustion engine has been started. By virtue of the disposition and control of the sealing valve, it is ensured that the exhaust gases produced during a starting phase of the engine which are normally loaded with soot are not transmitted through the charging air line.

According to a further feature of the present invention, the hydrostatic drive system is provided with a means for varying the transmission ratio thereof, whereby the flow of the pressure medium is controlled so that the drive of the hydrostatic drive system can be selectively increased or decreased.

Moreover, according to the present invention, the pressure medium for the hydrostatic drive system is constituted by the lubricating oil of the internal combustion engine, whereby it is unnecessary to provide a separate pressure medium supply or source, nor an additional source of energy to drive the rotor or cell wheel.

Preferably, according to another advantageous feature of the present invention, the hydrostatic drive system includes an oil pump and an oil motor with the oil motor being of a trochoidal construction and including an inner rotor connected to a driven or driving shaft disposed eccentrically within an outer rotor with each of the rotors being provided with cooperating gear teeth.

In accordance with another feature of the present invention, to vary the transmission ratio of the hydrostatic drive system, an eccentric bearing bush is provided and disposed between a housing of the oil motor and the outside rotor, whereby the eccentricity between the inner and outer rotors relative to inlet and outlet openings is changed.

Furthermore, to permit a fine adjustment between the rotational speeds of the rotor or cell wheel and the internal combustion engine, an adjusting means is operatively connected to the eccentric bearing bush. The adjusting means may be manually adjusted or may be regulated by a control means responsive to predetermined operating parameters of the internal combustion engine.

In accordance with a further feature of the present invention, a hydraulic means is provided for controlling an opening and closing of the sealing valve with the hydraulic means being responsive to an oil pressure in a pressure medium line of the hydraulic return system.

Additionally, a delay means may be provided between the hydraulic means and a pressure medium line which controls the point in time in which the sealing valve is displaced from a closed position to an open position.

Accordingly, it is an object of the present invention to provide a gas dynamic wave machine or pressure exchanger arrangement for an internal combustion engine which avoids by simple means the drawbacks and disadvantages encountered in the prior art.

A further object of the present invention resides in providing a gas dynamic wave machine or pressure exchanger arrangement for an internal combustion engine which functions reliably under all operating conditions of the internal combustion engine.

Another object of the present invention resides in providing a gas dynamic wave machine or pressure exchanger arrangement for an internal combustion engine, the location of which relative to the internal combustion engine is freely selectable.

Yet another object of the present invention resides in providing a gas dynamic wave machine or pressure exchanger arrangement for an internal combustion engine which is insensitive to temperature and which is essentially free of maintenance.

Still a further object of the present invention resides in providing a gas dynamic wave machine or pressure exchanger arrangement for an internal combustion engine in which the speed of revolution of the rotor or cell wheel of the internal combustion engine can be readily matched in a structurally simple manner.

An additional object of the present invention resides in providing a gas dynamic wave machine or pressure exchanger arrangement for an internal combustion engine whereby a structurally simple control is provided for the valve in a charging air line.

These and other objects, features and advantages of the present invention will become more apparent from the following description when taken in connection with the accompanying drawings which show, for the purposes of illustration only, one embodiment in accordance with the present invention, and wherein.

Figure 1:
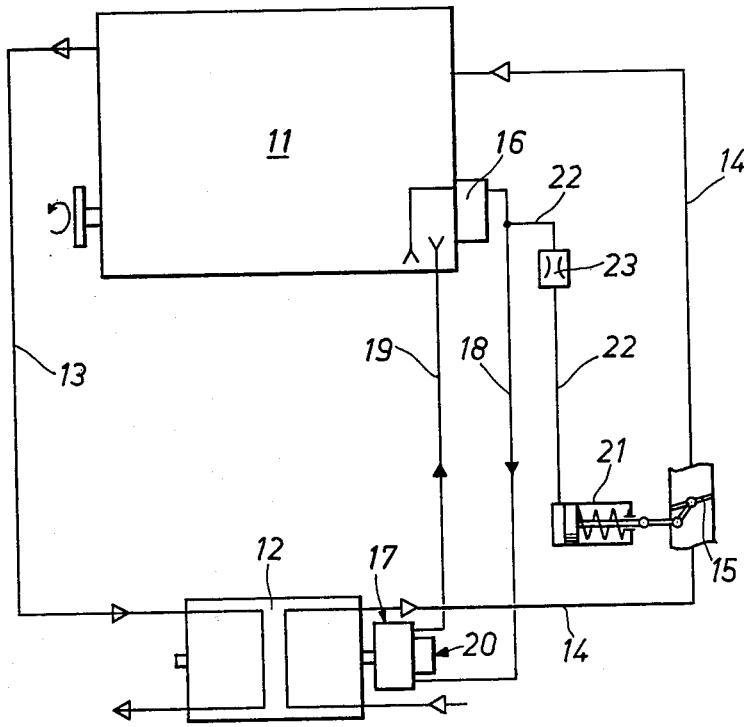
FIG. 1 is a schematic illustration of a gas dynamic wave machine or pressure exchanger arrangement in accordance with the present invention operatively associated with an internal combustion engine.

Referring now to the drawings wherein like reference numerals are used throughout the various views to designate like parts and, more particularly, to FIG. 1, according to this figure, an internal combustion engine 11 is provided which employs the energy content of the exhaust gas as a charging air for a gas dynamic wave machine or pressure exchanger 12. For this purpose, exhaust gases from the internal combustion engine 11 are fed by way of an exhaust manifold 13 to the exhaust gas dynamic wave machine or gas dynamic pressure exchanger 12 with charging air for the internal combustion engine 11 being precompressed in the wave machine 12 and fed to the respective cylinders (not shown) of the internal combustion engine 11 through a charging air line 14. The wave machine 12 may be of the type disclosed, for example, in Swiss Pat. No. 225,426, U.S. Pat. No. 3,086,697, or SAE Publication No. 750,335, Feb. 24–28, 1975, entitled "Comprex Supercharging of Vehicle Diesel Engines".

A hydrostatic drive system of the type disclosed, for example, in "Pumpen-Atlas I", Stiess, A. G. T-Verlag, 1966, pages 113/114, 153–155, is provided for driving the rotor or cell wheel (not shown) of the gas dynamic wave machine 12. The hydrostatic drive system has an adjustable transmission ratio and utilizes as a pressure medium the lubricating oil of the internal combustion engine 11.

The hydrostatic drive system includes an oil pump 16, driven by the internal combustion engine 11 in a conventional manner, and an oil motor generally designated by the reference numeral 17 which drives the rotor or cell wheel of the gas dynamic wave machine 12. As shown most clearly in FIGS. 2 and 3, the oil motor 17 is of a trochoidal construction and includes a fixed housing 28 in which is accommodated a first drive component constructed as an inner rotor 26 having gear teeth disposed about an outer periphery thereof. The inner rotor 26 is connected to a driven or driving shaft 25 which is disposed eccentrically with a second drive component constructed as an outer rotor 27 having gear teeth arranged on an inner surface thereof which cooperate with the gear teeth of the inner rotor 26.

The oil pump 16 is also of trochoidal construction and includes an externally toothed inner rotor (not shown) connected with a drive shaft (not shown) disposed eccentrically inside an internally toothed external rotor (not shown), all of which are arranged in a fixed housing (not shown).

The lubricating oil is fed from an oil reservoir (not shown) of the internal combustion engine 11 through a line 18 to the oil motor 17 and is returned therefrom by way of a return line 19. By virtue of the use of a hydrostatic drive system, a free selection of the location of the gas dynamic wave machine or pressure exchanger 12 is possible since the source of power or drive for the oil motor 17 is achieved by way of the lines 18, 19 which, by virtue of the flexibility of such lines, may also be located in various positions.

Figure 2:
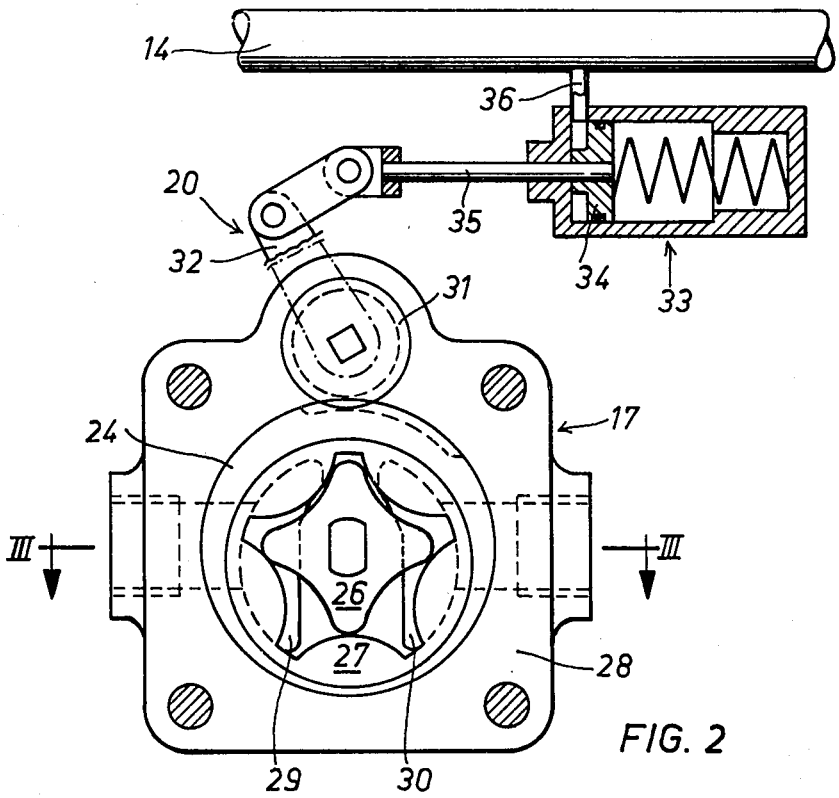
FIG. 2 is a cross-sectional detail view of an oil motor and adjustment device in accordance with the present invention.
Figure 3:
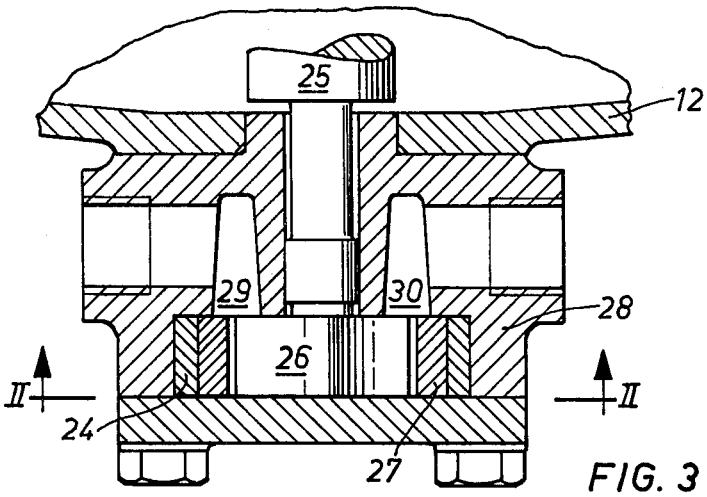
FIG. 3 is a cross-sectional view taken along the line III—III of FIG. 2.

To provide for the adjustable transmission ratio of the hydrostatic transmission system, that is, to permit a changing or varying of the transmission ratio between the oil pump 16 and oil motor 17, as also shown in FIGS. 2 and 3, an eccentric bearing bush 24 is disposed between the fixed housing 28 of the oil motor 17 and the outer surface or side of the outside rotor 27 of the oil motor 17. An adjustment or setting device generally designated by the reference numeral 20 is provided and operatively connected with the bearing bush 24 so as to permit an external adjustment of the bearing bush 24, whereby it is possible to vary the degree of eccentricity between the inner and outer rotors 26, 27 relative to inlet or intake and outlet or discharge openings 29, 30, respectively, for the pressure medium provided in the fixed housing 28. The adjustment of the eccentricity varies or controls the flow-through of the pressure medium and, proportional to the flow-through, the speed or number of revolutions per minute of the oil motor 17 so that the speed or the oil motor 17 can be selectively increased or decreased.

The adjustment or setting device 20 may be constructed so as to permit a fine adjustment of the relative rotational speed relationship of the rotor or cell wheel of the gas dynamic wave machine or pressure exchanger 12 and the internal combustion engine 11 in a test run.

Additionally, it is possible to associate a control or regulator device generally designated by the reference numeral 33 with the adjustment or setting device 20 with the control device 33 responding to predetermined operating parameters of the internal combustion engine 11, for example, air charge pressure, so that in all operating conditions of the internal combustion engine 11, the gas dynamic wave machine or pressure exchanger 12 is automatically optimally adjusted.

The regulator 33 may include a spring-loaded piston 34 which is acted upon by the air charge pressure through a conduit or connection 36 between the charging air line 14 and the housing accommodating the spring-loaded piston 34. By virtue of the connection 36, the air charge pressure prevailing in the charging air line 14 effects a displacement of the piston 34 which acts, by way of a rod 35 connected to the piston 34, on the adjustment or setting device 20 so as to automatically vary the degree of eccentricity of the bearing bush 24, thereby providing an automatic optimal adaptation of the gas dynamic wave machine or pressure exchanger 12 in all operational states of the internal combustion engine 11.

A hydraulic cylinder 21 is provided to control the selective opening and closing of a sealing valve 15 disposed in the charging air line 14 from the hydrostatic drive system to the internal combustion engine 11. The sealing valve 15 and hydraulic cylinder 21 are operatively associated in such a manner that the sealing valve 15 automatically moves to a closed position when the internal combustion engine 11 is inoperative or shut off.

The hydraulic cylinder 21 communicates with the pressure medium line 18 of the hydrostatic drive system by way of a pressure medium line 22, whereby the pressure medium from the line 18 acts upon the hydraulic cylinder 21. A delay element 23 is arranged in the line 22 between the junction thereof with the line 18 and the hydraulic cylinder 21. The delay element 23 functions to open the sealing valve 15 at a predetermined fixed time interval after the internal combustion engine 11 has been started.

The delay element 23 may be fashioned as a restriction in the pressure medium line 22. By such a construction, there would be a slower pressure build-up in the hydraulic cylinder 21, thereby leading to a predetermined or desired delay in the opening of the sealing valve 15 until the predetermined time interval after the start of the internal combustion engine 11 has lapsed.

Exhaust gas and fresh air simultaneously and sequentially enter the chambers (not shown) of the rotor or cell wheel after the internal combustion engine 11 is started. However, the delay element 23 functions so as to ensure that the sealing valve 15 opens only upon a completion of the starting phase of the internal combustion engine 11 since, during a starting phase, the exhaust gas produced is heavy with impurities. In order to be able to start the internal combustion engine 11, the delay time interval of the delay element 23 for opening the sealing valve 15 is determined on the basis of the volume of fresh air in the charging air line 14 which would be consumed during a starting operation of the internal combustion engine 11.

While we have shown and described only one embodiment in accordance with the present invention, it is understood that the same is not limited thereto, but is susceptible of numerous changes and modifications as would be known to a person of ordinary skill in the art to which it pertains, and we therefor do not wish to be restricted to the details shown and described herein, but intend to cover all such changes and modifications as are encompassed by the scope of the appended claims.

We claim:

1. A gas dynamic wave machine for a supercharged internal combustion engine, the wave machine including a rotor wheel, an independent drive means for driving the rotor wheel, a charging air line means interposed between the wave machine and cylinders of the internal combustion engine, and means for selectively opening and closing the charging air line means in dependence upon an operative state of the internal combustion engine, characterized in that the independent drive means is a hydrostatic drive means, characterized in that the independent drive means is a hydrostatic drive means, in that means are provided for varying a transmission ratio of the hydrostatic drive means, in that a pressure medium of the hydrostatic drive means is constituted by a lubricating oil from a lubricating system of the internal combustion engine, in that the hydrostatic drive means includes an oil pump means operatively connected to the gas dynamic wave machine, in that the oil motor means is of a trochoidal construction and includes an inner rotor having on an outer surface thereof a plurality of gear teeth, said inner rotor being operatively connected to one of a drive and driven shaft, an outer rotor having on an inner surface thereof a plurality of gear teeth cooperable with the gear teeth on said inner rotor, said inner rotor being disposed eccentrically within the outer rotor, and a housing means for accommodating said inner and outer rotors, in that means are provided for changing the degree of eccentricity between the inner and outer rotors relative to pressure medium inlet and outlet openings of the oil motor means, in that said charging means is an eccentric bearing bush disposed between the housing means and the outer rotor of the oil motor means, in that an adjusting means is operatively connected with said bearing bush for rotating said bearing bush, said adjusting means being accessible from outside of said housing means so as to permit a fine adjustment of the degree of eccentricity, in that means are operatively connected with said adjusting means for controlling a positioning of the adjusting means in response to predetermined operating parameters of the internal combustion engine, and in that the means for selectively opening and closing the charging air line means includes a sealing valve disposed in the charging air line means, and a hydraulic cylinder means operatively connected with said sealing valve and said hydrostatic drive means whereby said sealing valve is actuated by a pressure of the pressure medium of the hydrostatic drive means.

2. The gas dynamic wave machine according to claim 1, characterized in that a pressure medium line is provided between the hydraulic cylinder means and the hydrostatic drive means, and in that a delay means is interposed in said pressure medium line for delaying an opening of the sealing valve for a predetermined time interval following a starting operation of the internal combustion engine.

3. A gas dynamic wave machine for a supercharged internal combustion engine, the wave machine including a rotor wheel, an independent drive means for driving the rotor wheel, a charging air line means interposed between the wave machine and cylinders of the internal combustion engine, and means for selectively opening and closing the charging air line means in dependence upon an operative state of the internal combustion engine, characterized in that the independent drive means is a hydrostatic drive means, and in that the means for selectively opening and closing the charging air line means includes a sealing valve disposed in the charging air line means, and a hydraulic cylinder means operatively connected with said sealing valve and said hydrostatic drive means whereby said sealing valve is actuated by a pressure of the pressure medium of the hydrostatic drive means.

4. The gas dynamic wave machine according to claim 3, characterized in that a pressure medium line is provided between the hydraulic cylinder means and the hydrostatic drive means, and in that a delay means is interposed in said pressure medium line for delaying an opening of the sealing valve for a predetermined time interval following a starting operation of the internal combustion engine.

* * * * *